US005098083A

United States Patent [19]

Miyoshi et al.

[11] Patent Number: 5,098,083

[45] Date of Patent: Mar. 24, 1992

[54] MULTIPLE SORTER

[75] Inventors: Jun Miyoshi; Yoshio Sugishima, both of Osaka; Nobukazu Otsuka, Nara; Hiroyuki Nagai; Takatoshi Nishimura, both of Osaka; Keiichi Taguchi, Kyoto, all of Japan

[73] Assignee: Mita Industrial Co., Ltd., Osaka, Japan

[21] Appl. No.: 625,072

[22] Filed: Dec. 7, 1990

[30] Foreign Application Priority Data

Dec. 9, 1989 [JP] Japan ..... 1-319753

[51] Int. Cl.[5] ..... B65H 31/24

[52] U.S. Cl. ..... 271/289; 271/273; 271/188

[58] Field of Search ..... 271/280, 289, 290, 273, 271/274, 188, 209

[56] References Cited

U.S. PATENT DOCUMENTS 3,467,371 9/1969 Britt ..... 271/290
3,774,906 11/1973 Fagan ..... 271/289
4,872,662 10/1989 Ishikawa ..... 271/290

*Primary Examiner*—Richard A. Schacher
*Attorney, Agent, or Firm*—Cushman, Darby & Cushman

[57] ABSTRACT

A multiple sorter includes several sorter units disposed in series at a paper discharge outlet of an image forming apparatus. Each of the sorter units includes a paper distributing mechanism for distributing paper to several sort bins, and a first path change-over mechanism for changing over the connection of a paper lead-in path to either a paper feeding path to the paper distributing mechanism or a paper discharging path to a non-sort bin. The sorter also includes several bypass carrying paths, each provided across the paper discharging path of each of the sorter units and the paper lead-in path of another one of the sorter units which is adjacent to the one sorter unit in a serially connecting direction of the sorter units. The non-sort bin is provided on an upper portion of the bypass carrying path of each one of the sorter units so that the non-sort bin serves another one of the sorter units upstream of the one sorter unit. The sorter further includes several second path change-over mechanisms, each for switching the connection between the paper discharging path to the non-sort bin and the bypass carrying path.

8 Claims, 4 Drawing Sheets

MULTIPLE SORTER

BACKGROUND OF THE INVENTION

1. Field of the Invention

The present invention relates to a multiple sorter in which a plurality of sorter units are provided in series at a paper discharge outlet of an image forming apparatus and in which a bypass carrying path is provided between each pair of the sorter units adjacent to each other in the serial direction of the units so that the bypass carrying path is directed to one of the pair of sorter units at the downstream side in the serial direction of the units.

2. Description of the Related Art

A multiple sorter has been proposed which comprises: a plurality of sorter units disposed in series at a paper discharge outlet of an image forming apparatus, each of the sorter units including a sorter casing provided with a paper lead-in path, a plurality of vertically arranged stages of sort bins provided in the sorter casing, a paper distributing means also provided in the sorter casing for distributing paper to the sort bins, and a first path change-over mechanism for changing over the connection of the paper lead-in path to either a paper feeding path to the paper distributing means or a paper discharging path to a non-sort bin; a plurality of bypass carrying paths each provided across the paper discharging path of each one of the sorter units and the paper lead-in path of another of the sorter units which is adjacent to the sorter unit in the serially connecting direction of the sorter units, the non-sort bin being provided on an upper portion of the bypass carrying path of each one of the sorter units so that the non-sort bin serves for another one of the sorter units provided at the upstream side of the one sorter unit; and a plurality of second path change-over mechanisms each for switching the connection between the paper discharging path to the non-sort bin and the bypass carrying path.

Each conventional bypass carrying path in the multiple sorter is constituted by upper and lower carrying elements each constituted by carrier rollers provided at predetermined intervals in the carrying direction and a guide plate. A non-sort bin is provided on an upper portion of the upper carrying element.

In such a configuration, in order to clear jams between the upper and lower carrying elements or other maintenance, an upper casing portion for bypass carrying the non-sort bin and the upper carrying element can be raised. However, since the upper casing portion is large and heavy, it is considerably difficult to perform the opening operation. In order to facilitate the opening operation, for example, a balance spring may need to be provided, increasing cost. Further, the upper and lower carrying elements constituting the bypass carrying path include expensive carrier rollers and guide plates.

SUMMARY OF THE INVENTION

An object of the present invention is to eliminate the foregoing disadvantages.

To achieve this object, the present invention provides a multiple sorter having a bypass carrying path in which a lower carrying element comprises carrier rollers provided at predetermined intervals in the carrying direction and a guide plate. The non-sort bin is also used as a portion of the upper carrying element, and is arranged so as to be vertically movable.

The upper and lower carrying elements are released from each other by raising only the non-sort bin, which is also used as the upper carrying element. A balance spring or the like can be eliminated because the non-sort bin is relatively small and light weight.

Embodiments of the present invention will be described with reference to the accompanying drawings.

DETAILED DESCRIPTION OF THE PREFERRED EMBODIMENTS

Figure 1:
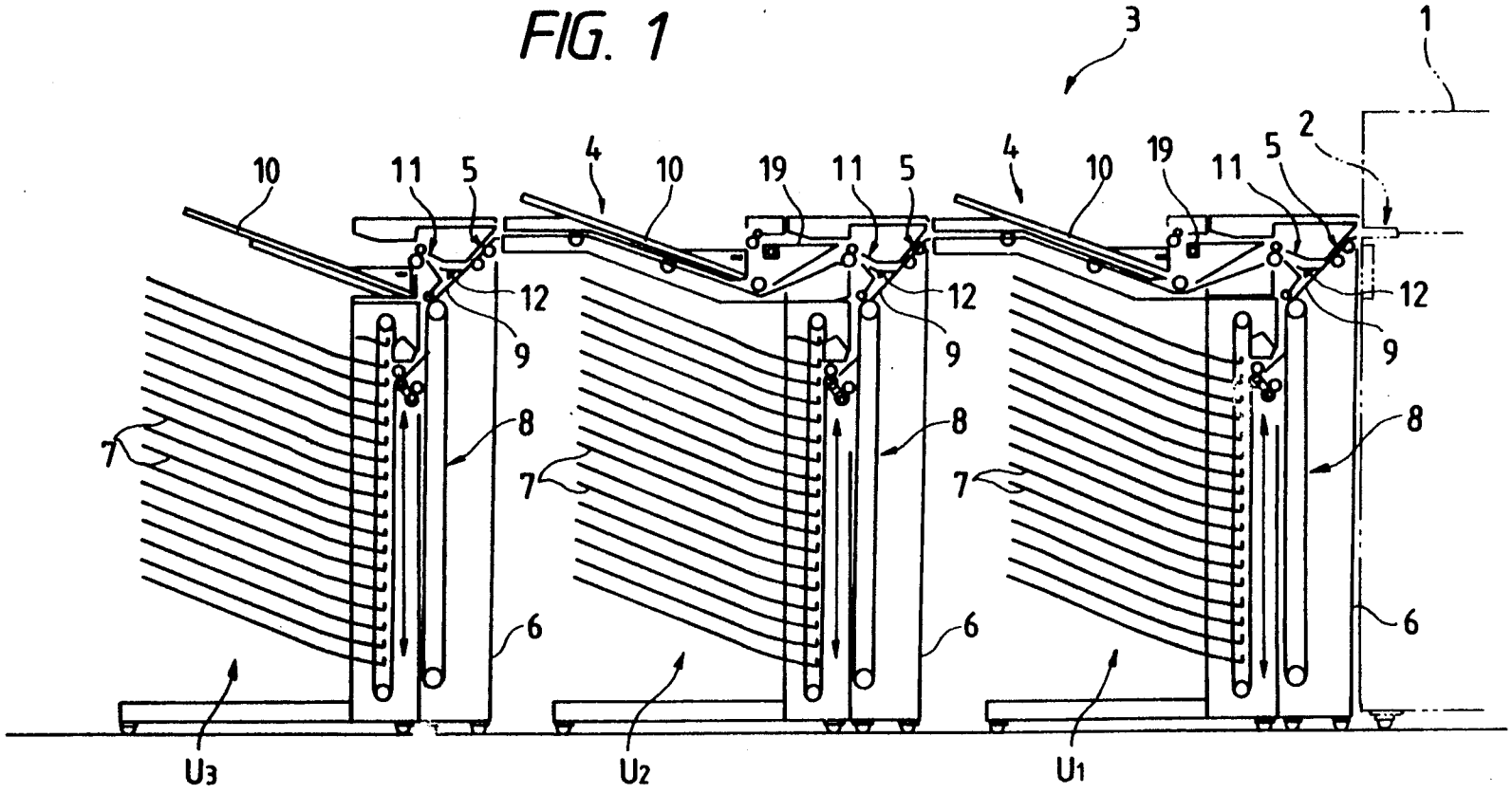
FIG. 1 is a schematic longitudinally sectional side view of the multiple sorter.

FIG. 1 shows a triple sorter 3 serially connected to a paper discharge outlet 2 of an electrostatic photo-copying machine (an example of the image forming apparatus). The triple sorter 3 includes a first sorter unit $U_1$ directly connected to the paper discharge outlet 2, a second sorter unit $U_2$ connected to the first sorter unit $U_1$ through a bypass carrying path 4, and a third sorter unit $U_3$ similarly connected to the second sorter unit $U_2$ through another bypass carrying path 4.

Each of the first, second, and third sorter units $U_1$ through $U_3$ includes a sorter casing 6 provided with a paper lead-in path 5, a plurality of vertically arranged stages of sort bins 7 provided in the sorter casing 6, a paper distributing means 8 also provided in the sorter casing 6 for distributing paper to the sort bins 7, and a first path change-over mechanism 12 for changing over the connection of the paper lead-in path 5 to either a paper feeding path 9 to the paper distributing means 8 or a paper discharging path 11 to a non-sort bin 10.

Figure 2:
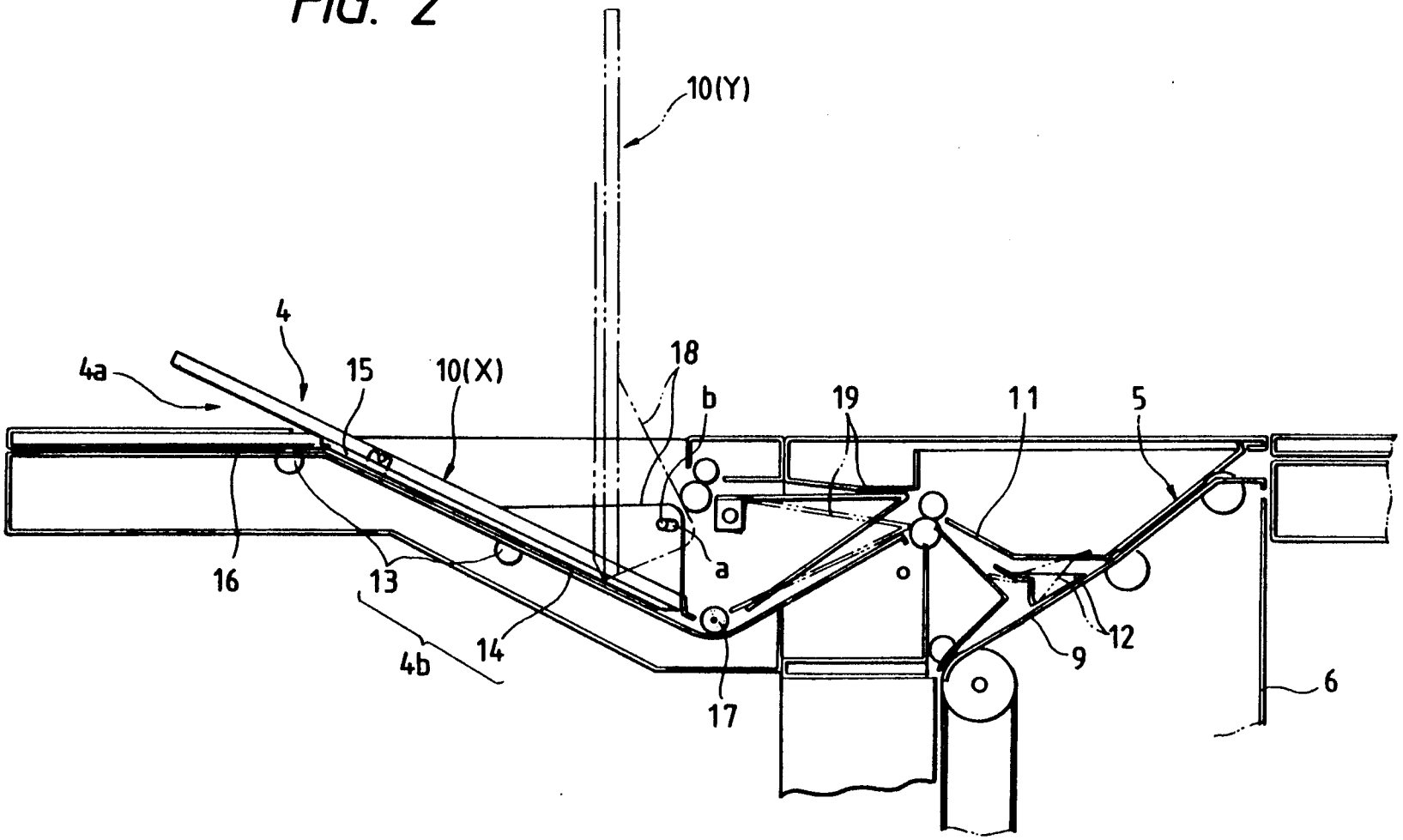
FIG. 2 is a sectional view of the bypass carrying path.
Figure 3:
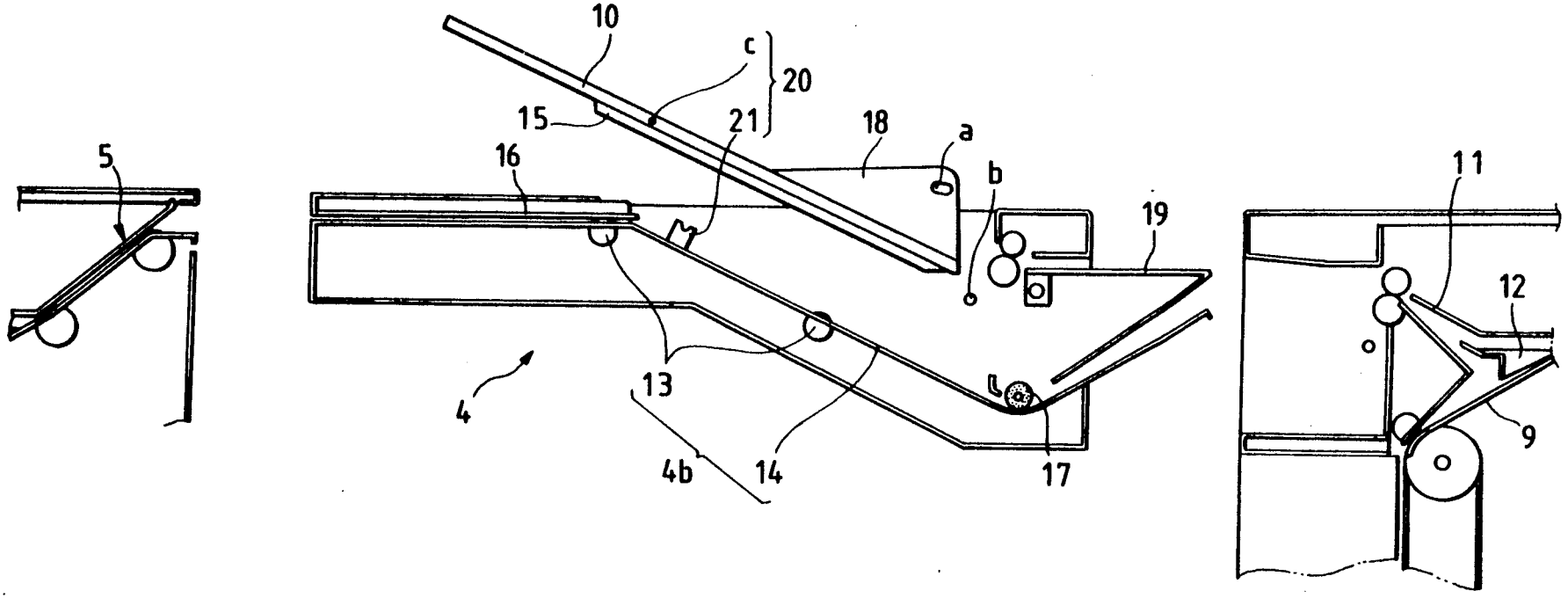
FIG. 3 is a sectional view showing the bypass carrying path when the non-sort bin is separated from the bypass carrying path.
Figure 4:
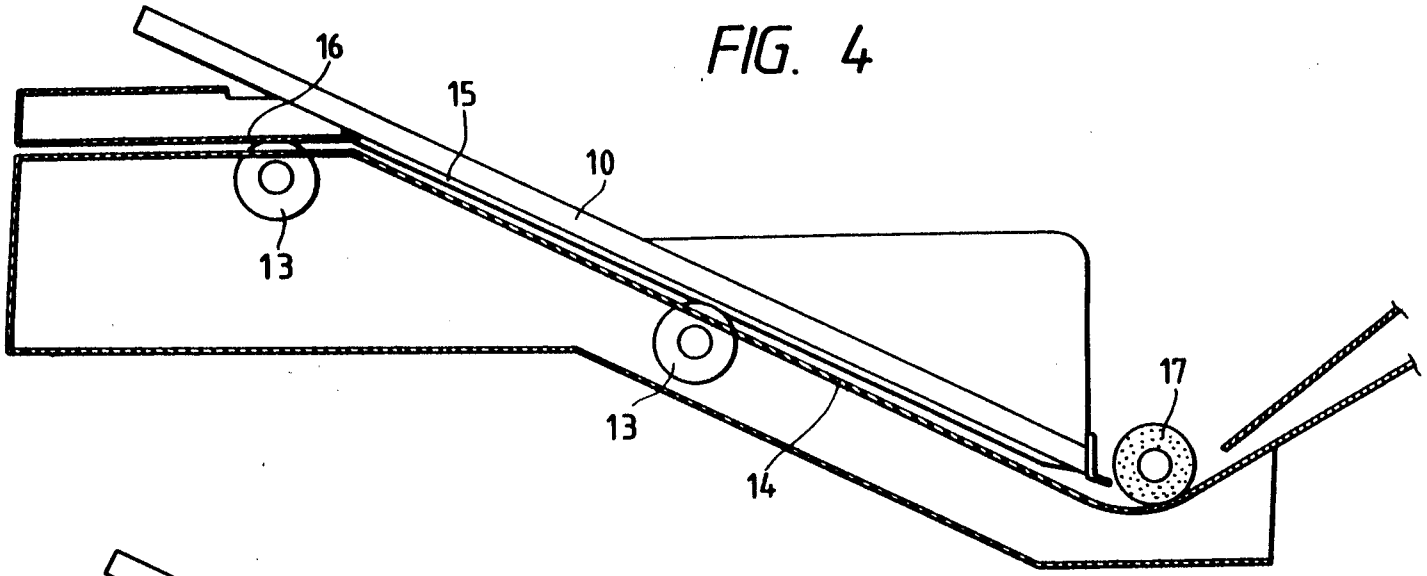
FIG. 4 is a partial enlarged view of the bypass carrying path.

In each pair of adjacent sorter units in the serially connecting direction of the sorter units, the bypass carrying path 4 is provided across the paper discharging path 11 of the upstream side sorter unit and the paper lead-in path 5 of the downstream side sorter unit. As shown in FIGS. 2 through 4, the bypass carrying path 4 includes upper and lower carrying elements **4*a* and 4*b* bounded by the carrying path. The non-sort bin 10 is provided on an upper portion of the bypass carrying path 4, and the bypass carrying path 4 is provided with a second path change-over mechanism 19 for switching the connection between the paper discharging path 11 and the bypass carrying path 4**.

The lower carrying element **4*b* includes a guide plate 14 and two carrier rollers 13 provided at a predetermined interval in the carrying direction. More specifically, the guide plate 14 has a first guide surface portion arranged so as to be in opposition to the second path change-over mechanism 19 and so as to slant downward, a second guide surface portion connected to the first guide surface portion at a portion below the non-sort bin 10 and arranged so as to slant upward, and a third guide surface portion connected to the second guide surface portion and arranged so as to be substantially horizontal. Further, the two carrier rollers 13** are provided so as to partially slightly project upward from the second and third guide surface portions.

The upper carrying element 4a includes, on the other hand, a plurality of ribs 15 projecting downward which are provided along the carrying direction so as to abut on the lower surface portion of the non-sort bin 10, a guide plate 16 which is connected to the ribs 15 at the downstream side thereof so as to be partially lapped on the ribs 15 and which is also partially lapped on the carrier roller 13, and a carrier roller 17 provided on a bent portion of the V-shaped first and second guide surface portions. That is, the non-sort bin 10 is also used as a part of the upper carrying element 4a. Further, the carrier roller 17 is made, for example, of sponge, and partially inserted into an opening formed in the bent portion.

Each of the carrier rollers 13 of the lower carrying element 4b is divided into plural parts in the direction of the rotary axis thereof, and the lower end edge of each of the ribs 15 is slightly inserted into a gap between the divisional roller portions so that paper to be carried is carried while being bent so as to be slightly serpentine in its width direction.

Further, brackets 18 are projectingly provided on the widthwise opposite sides of a base portion of the non-sort bin 10, and holes a elongated in the paper discharging direction are formed through the brackets 18. The elongated holes a are engaged with pins b provided in the bypass carrying path 4 so that the non-sort bin 10 is changed over between the paper receiving attitude X in which the non-sort bin also constitutes a part of the upper carrying element 4a and the swinging-up attitude Y in which the non-sort bin 10 is swung upward to open between the upper and lower carrying elements 4a and 4b.

A lock means 20 is provided for establishing the paper receiving attitude X of the non-sort bin 10. The lock means 20 pins c projectingly provided on the widthwise opposite sides of the non-sort bin 10, and members 21 provided on the bypass carrying path 4 side for elastically receiving the pins c therein.

According to the foregoing configuration, the non-sort bin 10 is provided in each of the sorter units $U_1$ through $U_3$. Therefore, when a predetermined number of sheets of paper are accommodated, for example, in the non-sort bin 10 of the first sorter unit $U_1$, the second path change-over mechanism 19 is controlled so as to perform change-over to thereby feed the non-sorted paper into the second sorter unit $U_2$.

When a predetermined number of sheets of paper are also accommodated in the non-sort bin 10 of the second sorter unit $U_2$, the non-sorted paper is fed into the non-sort bin 10 of the third sorter unit $U_3$, so that the quantity of accommodated non-sorted paper in the whole multiple sorter can be increased.

If jamming occurs in the sort mode, paper upstream from the sorter unit which is sorting, is taken into a suitable non-sort bin 10, so that the quantity of useless paper can be minimized.

Further, since the non-sort bin 10 is also a part of the upper carrying element 4a, the cost of the bypass carrying path 4 can be reduced, and the small light weight non-sort bin 10 is easily opened for clearing jamming and other maintenance.

Although the non-sort bin 10 is used as a part of the upper carrying element 4a, the non-sort bin 10 may be provided over the whole lower carrying element 4b so as to also constitute the whole upper carrying element 4a.

Further, although the lower edge portion of each of the ribs 15 provided on the lower surface portion of the non-sort bin 10 extending perpendicularly downward thereto is made to be slightly inserted into a gap between the divisional roller portions of each of the carrier rollers 13, the lower edge portion of each rib 15 may be made to accord with the circumferential surface of the carrier roller 13 when viewed from the rotary-axial direction of the carrier roller 13.

Figure 5:
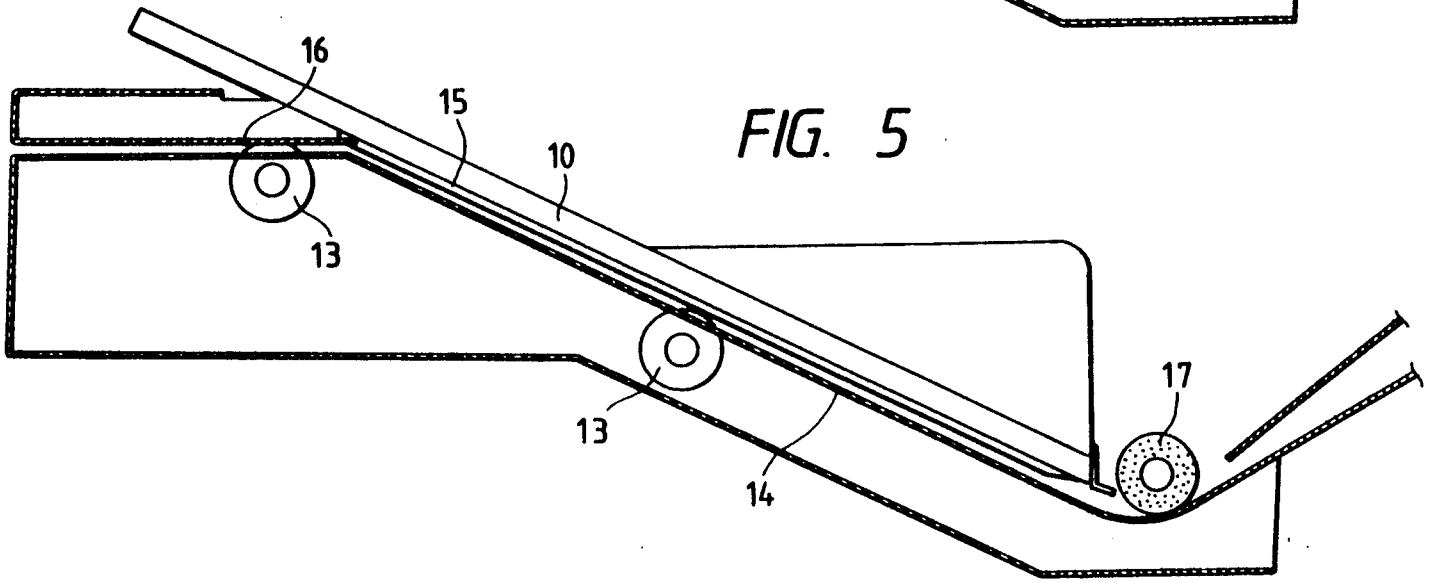
FIG. 5 is a partial enlarged view of the bypass carrying path showing another embodiment.

Moreover, when the first and second guide surface portions of the guide plate 14 of the bypass carrying path 4 are made to be V-shaped, paper is bent in a V-shape so that it abuts the carrier rollers 13 of the lower carrying element 4b firmly so as to receive a carrying force. Therefore, even if an extremely small gap (preferably, 1 mm or less) is provided between the lower edge portions the ribs 15 and the carrier roller 13 as shown in FIG. 5, paper can be carried. Further, even if the ribs 15 are eliminated, paper can be carried. Consequently, the lower surface portion of the non-sort bin 10 itself may be also be used to constitute a part of the upper carrying element 4a.

As described above, the multiple sorter according to the present invention has such a feature that the non-sort bin is also used to constitute at least a part of the upper carrying element of the bypass carrying path between front and rear sorter units of the multiple sorter and that the non-sort bin is provided so as to be able to be raised.

Further, since the non-sort bin is also used to constitute a part of the upper carrying element, the cost of the bypass carrying path can be reduced.

Moreover, the upper and lower carrying elements can be released from each other by raising the non-sort bin, and clearing of jamming and other maintenance, which requires the upper and lower carrying elements to be released from each other, can be easily performed because the non-sort bin and light weight. Furthermore, a balance spring or the like required for facilitating the release between the carrying elements can be eliminated.

What is claimed is:

1. A multiple sorter comprising:

a plurality of sorter units disposed in series at a paper discharge outlet of an image forming apparatus, each of said sorter units including a sorter casing provided with a paper lead-in path, a plurality of vertically arranged stages of sort bins provided in said sorter casing, a paper distributing means also provided in said sorter casing for distributing paper to said sort bins, and a first path change-over mechanism for changing over the connection of said paper lead-in path to one of a paper feeding path to said paper distributing means and a paper discharging path to a non-sort bin, a lower surface of said non-sort bin also serving as at least a part of an upper carrying element, said non-sort bin being separately and individually raisable;

a plurality of bypass carrying paths, each provided across the paper discharging path of each of said sorter units and the paper lead-in path of another one of said sorter units which is adjacent to said one sorter unit in a serially connecting direction of said sorter units, said non-sort bin being provided on an upper portion of said bypass carrying path of each one of said sorter units so that said non-sort bin serves another one of said sorter units upstream of said one sorter unit, each of said bypass carrying paths comprising a lower carrying element which has carrier rollers provided at predetermined intervals in the carrying direction and a guide plate; and a plurality of second path change-over mechanisms, each for switching the connection between said paper discharging path to said non-sort bin and said bypass carrying path.

2. A multiple sorter as in claim 1, wherein said carrying rollers of said lower carrying element are divided into plural parts in the direction of the rotary axis thereof.

3. A multiple sorter as in claim 2, wherein said lower surface portion of said non-sort bin has a plurality of ribs projecting downward along the carrying direction, a lower end edge of each of said ribs being slightly inserted into a gap between the divided roller portions so that paper to be carried is carried while being bent so as to be slightly serpentine in its width direction.

4. A multiple sorter as in claim 3, wherein said guide plate of said bypass carrying path is V-shaped.

5. A multiple sorter as in claim 2, wherein said guide plate of said bypass carrying path is V-shaped, said lower surface portion of said non-sort bin has a plurality of ribs projecting downward along the carrying direction, and a small gap is provided between said lower edge portions of said ribs and said carrier roller.

6. A multiple sorter as in claim 1, further comprising brackets projectingly provided on the widthwise opposite sides of a base portion of said non-sort bin, and through which holes elongated in the paper discharging direction are formed, wherein said non-sort bin is changed over between a paper receiving attitude in which said non-sort bin also constitutes a part of said upper carrying element and a swinging-up attitude in which said non-sort bin is swung upward to open between the upper and lower carrying elements.

7. A multiple sorter as in claim 6, further comprising locking means for establishing the paper receiving attitude of said non-sort bin.

8. A multiple sorter as in claim 7, wherein said locking means comprises:

a plurality of pins projectingly provided on the widthwise opposite sides of said non-sort bin, and a plurality of members provided on said bypass carrying path side for elastically receiving said pins therein.

* * * * *